United States Patent [19]

Sheehan

[11] Patent Number: 4,827,649

[45] Date of Patent: May 9, 1989

[54] SAFETY DEVICE

[76] Inventor: Maurice J. Sheehan, 3 Darbyshire Court, Mill Park, Victoria 3082, Australia

[21] Appl. No.: 115,024

[22] Filed: Oct. 30, 1987

[30] Foreign Application Priority Data

Oct. 30, 1986 [AU] Australia ..... PH8743

[51] Int. Cl.[4] ..... F41C 11/02

[52] U.S. Cl. ..... 42/70.11

[58] Field of Search ..... 42/70.11

[56] References Cited

U.S. PATENT DOCUMENTS 2,479,107 8/1949 Garretson ..... 42/70.11

2,836,918 6/1958 Pula et al. ..... 42/70.11

3,768,189 10/1973 Goodrich ..... 42/70.11

4,512,099 4/1985 Mathew ..... 42/70.11

*Primary Examiner*—Deborah L. Kyle

*Assistant Examiner*—R. L. Klein

*Attorney, Agent, or Firm*—Larson and Taylor

[57] ABSTRACT

A safety device for a firearm which is adapted to be received in the breech of the firearm and which has a retaining member located in but extending through the body thereof, which retaining member can either be in a condition where it is in contact with the breech and acts to prevent outward movement of the device, to a position where it does not obstruct any such outward movement, whereby the safety device can be readily removed from the breech. Preferably, the two positions of the retaining means are controlled by a key operated lock.

7 Claims, 1 Drawing Sheet

SAFETY DEVICE

This invention relates to a safety device and, in particular, to a device which is adapted to be located in the breech of a firearm to prevent unauthorised use of the firearm.

Some firearms, for example many double barrelled shotguns, are loaded by breaking the firearm so that the barrel and breech asembly rotates away from the remainder of the firearm and the cartridges are loaded by being placed into the breech and then the barrel is rotated to its initial position and locked to the remainder of the firearm.

In such firearms, the firing mechanism, including the trigger, a cocking mechanism and a firing pin, are completely isolated from the barrel and, in many applications, these are basically very simple mechanisms which have a hammer which can be cocked and released by the trigger to strike the rear of the firing pin which simply passes through an aperture in such a position as to strike the percussion cap of a cartridge located in the breech.

It is an object of the present invention to provide a device whereby such firearms can be secured so that unauthorised persons cannot place a cartridge into the breech and thus the firearm cannot be used.

In its broadest sense, the invention includes a safety device having a body which is of a diameter and length to be received in the breech and extend a substantial part of the length thereof, retaining means located substantially in the body and selectively moveable from a position at which it causes no obstruction to the movement of the body to a position where it obstructs outward movement of the body, and means to act on the retaining means to cause it to adopt one of the two positions.

Preferably the retaining means is in the form of a resilient plate which extends outwardly through a recess in the body to contact the wall of the breech, the plate being deformable so that its effective length can be varied from a length that does not positively engage with the breech to a length where there is positive engagement.

In order that the invention may be more readily understood, I shall describe two forms of safety device made in accordance with the invention, in relation to the accompanying drawings, in which.

Figures 1, 2, 3, 4:
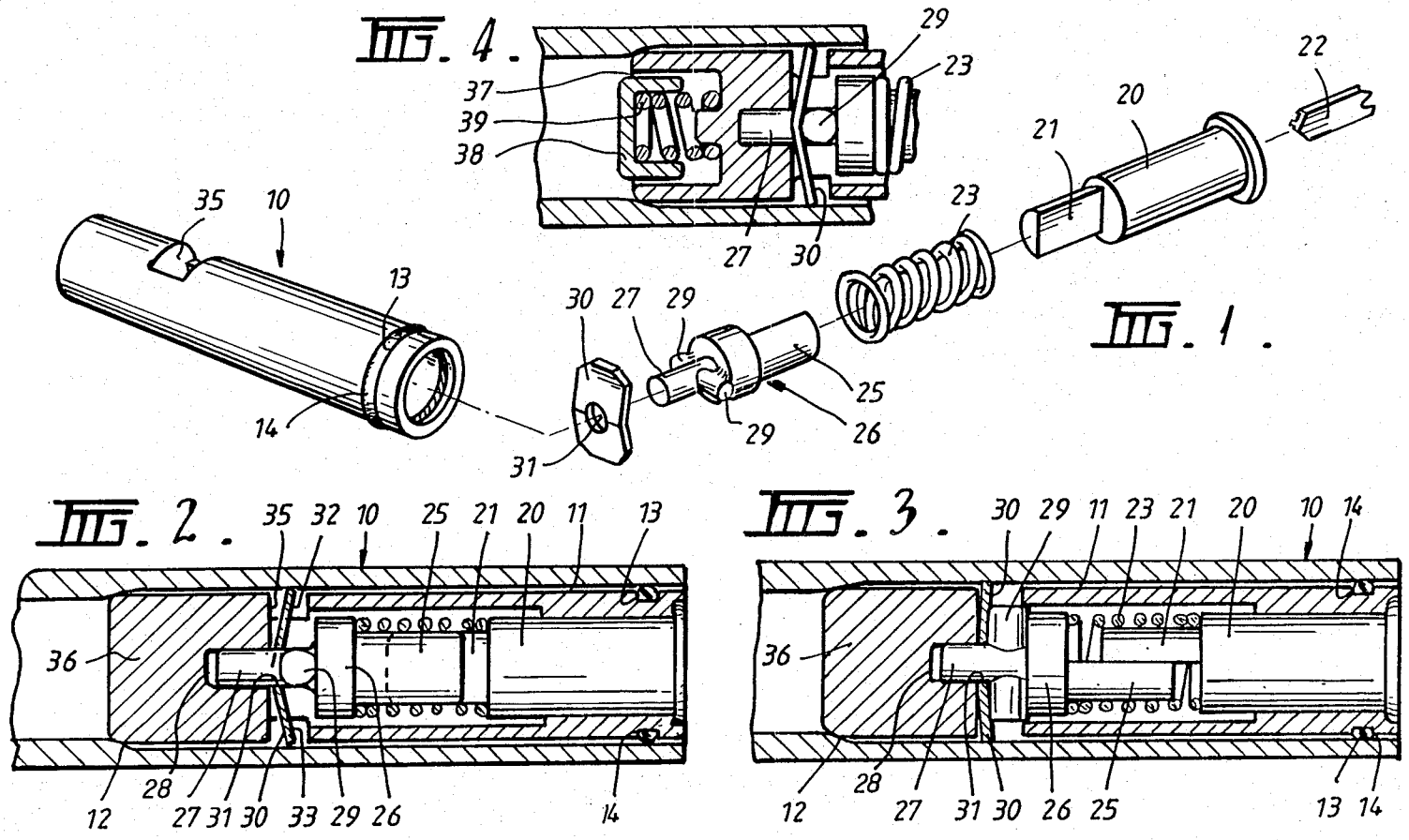
FIG. 1 is an exploded view of the safety device showing the various components.
FIG. 2 is a sectional view of the device showing it in its released condition whereby it can be removed from the chamber of the firearm.
FIG. 3 is a view similar to that of FIG. 2 but showing the device in its locked position.
FIG. 4 is a view of the forward end of the device as modified to prevent removal from shock loadings from the barrel direction.

The materials of construction of the safety device can be of various types, they could be basically of metal but they could be of a relatively solid plastics material.

In many applications as plastics material can be preferred as this will not cause any damage to the metal of the firearm breech.

The safety device has a body 10 which can effectively have a diameter equal to the diameter of a cartridge which would be used with the particular firearm and a length which will permit the body to be fully received within the head space in the breech 11 so that there is no rearward extension of the body from the breech.

It may be preferred that the length of the body is such that it contacts the shoulder 12 at the inner end of the head space of the breech, but this is not essential.

Alternatively, the body could have an annular rim, not illustrated, which could seat at the rear of the breech but, again, this is not essential.

At the rear of the body I provide an annular recess 13 which may receive an O-ring or a split metal 14 ring to locate the body 10 within the breech.

Located axially of the body there may be a lock mechanism 20 which has a keyhole extending axially outwardly and a shaft 21 or the like extending into the body.

The mechanism may be such that the key 22 can be inserted and removed at two different positions so that it is possible to insert the key in either of these positions, rotate the mechanism to the other position and remove the key therefrom.

The shaft 21 is semi-circular in cross section and is adapted to engage with a similar shaft 25 on an actuating member 26 which, at its forward end 27, is provided with an axial cylindrical extension which is adapted to pass into a blind aperture 28 in the inner end of the body.

The actuating member 26 has a pin or the like 29 which extends transversely through the cylindrical extension 27, as will be explained hereinafter.

The two shafts 21 and 25 are, when assembled, surrounded by an helical spring 23 which acts both to retain the shafts 21 and 25 substantially in abutment also provides an outward pressure between the shafts which, in turn, maintains a constant load on the locking plate.

A locking plate 30 which may be made spring steel or some other elastically deformable material, which has a central aperture 31 which is slightly larger than the extension 27, is located in a pair of diametric slots 35 which are formed in the body 10 adjacent the forward end 36 which has the counter bore 28 therein.

This plate 30 effectively has two arms 32 and 33 which are inclined relative to each other so that, when the plate 30 is located over the extension 27, and the device is in its unlocked position, the central portion of the plate abuts the pin 29.

Because the plate is, in this position, deformed, the spacing between the ends of the plate is generally less than, but not more than, the diameter of the breech.

Thus, in this condition, which is illustrated in FIG. 2, the device can be freely removed from the breech.

When the shafts 21 and 25 are rotated through 90°, through operation of the key 22 in the lock 20, then the pin 29 is also caused to rotate and this pin strikes the inner surface of the locking plate 30 and tends to straighten the locking plate so this achieves a condition similar to that shown in FIG. 3. This straightening operation increases the overall length of the locking plate sufficiently for its outer ends to come into a friction contact with the inner surface of the breech 11.

In this condition, it will be seen that it is very difficult to remove the safety device from the breech as, any attempt to move the body outwardly tends to cause the locking plate 30 to extend even more and thus to provide a barbed effect to prevent outward movement.

If, on the other hand, the actuating member 26 is rotated to its initial condition, then the plate 30 will resume its condition as shown in FIG. 2 and the safety device can readily be removed from the breech.

In use, it is preferred that the device be moved to its condition as shown in FIG. 3 before insertion into the barrel, that is to the position where the locking plate 30 actually extends beyond the diameter of the breech.

However, as the free ends of the arms 32 and 33 are each slightly rearwardly directed, it is possible to move the safety device into the bore of the firearm, as te arms 32 and 33 offer little restriction to movement in this direction.

If the safety device was fitted in the condition shown in FIG. 2, there could be certain difficulties in achieving the locked position as the safety device as a whole would tend to rotate in the breech and, because it is effectively solely in the breech, it would be difficult to hold against such rotation.

When the safety device is to be removed, it is basically simple to insert the key 22 and to rotate the actuating member 26 so that the pin 29 adopts the position illustrated in FIG. 2 and the safety device can be removed.

Whilst the safety device described hereinbefore is basically fully satisfactory, it is believed that it could be possible that this could be displaced by passing a rod or the like from the outer end of the barrel to abut the inner end of the safety device and then, by physical force, causing outward movement of the safety device against the gripping action of the arms 32 and 33.

It is believed, for such to be satisfactory, it may be necessary to apply shock loadings to the forward end 36 of the body of the safety device 10.

In order to minimise this likelihood, I provide a modified form of safety device which is illustrated in FIG. 4.

In this Figure, the end 36 is provided with a central counter bored aperture 37 in which there is located a shock absorbing member 38 which has associated therewith an helical spring 39 which is located against the inner end of the counter bore 37.

This arrangement is such that any shock loading in the member 38 simply tends to cause movement of the member 38 against the spring 39 and thus the energy applied to the member 38 is transformed to potential energy in the spring 39 and, when the loading is removed, this energy is dissipated by outward movement of the member 38.

It will be seen, therefore, that the modified form of safety device does provide means to minimise the effect of inward pressure by means of a rod or the like and tends to prevent any displacement of the safety device, even under shock loadings.

I claim:

1. A safety device having a body which is of a diameter and length to be received in a breech of a firearm having a barrel and extend a substantial part of the length of the breech, retaining means located substantially in the body, said retaining means being a resilient plate which extends outwardly through at least one aperture in the body to contact a wall of the breech to restrict outward movement of the device relative to the breech, the plate being deformable so that its effective length can be varied from a length that does not frictionally engage with the breech to a length where there is frictional engagement, and means to act on the retaining means to cause it to adopt one of the two positions.

2. A safety device as clamed in claim 1 wherein the retaining means passes through two substantially diametrically opposed apertures in the body and can frictionally engage the breech on two opposed sides thereof.

3. A safety device as claimed in claim 2 wherein the retaining means has two arms which are located at an obtuse angle to each other, the extension in length being achieved by relative movement of the arms towards a common plane.

4. A safety device as claimed in claim 3 wherein the actuating means include a pin which is mounted for rotation about an axis substantially normal said common plane of the resilient plate and which can adopt two positions, in one of which it lies along the line of connection of the two arms, so the arms can adopt their rest condition and, in the other of which, it lies along the axis of the arms causing deformation of the arms towards said common plane.

5. A safety device as claimed in claim 4, wherein the pin is diametrically located on a shaft which is associated with a lock mechanism whereby the pin can be rotated between its two positions.

6. A safety device as claimed in claim 1 wherein the end of the body which is directed towards the barrel is provided with a shock absorbing assembly.

7. A safety device as claimed in claim 6 wherein the shock absorbing assembly includes an helical spring located in the end of the body and an outwardly directed member which acts against the spring.

* * * * *